US007578257B1

(12) United States Patent
Capamaggio et al.

(10) Patent No.: US 7,578,257 B1
(45) Date of Patent: Aug. 25, 2009

(54) BOOKMARKER

(76) Inventors: Scott A. Capamaggio, 3755 Hunt Chase Dr., Greensboro, NC (US) 27407; Ross C. Amyot, 2343 Cheverie Street, Oakville, Ontario (CA) L6J 5W5

( * ) Notice: Subject to any disclaimer, the term of this patent is extended or adjusted under 35 U.S.C. 154(b) by 59 days.

(21) Appl. No.: 11/904,785

(22) Filed: Sep. 28, 2007

(51) Int. Cl.
*B42D 9/00* (2006.01)

(52) U.S. Cl. ..... 116/237; 116/234; 116/239; 281/42; D19/34

(58) Field of Classification Search ..... 116/234–240; 281/42, 45; 24/3.1, 3.11, 3.12, 67 R, 67.3, 24/67.5, 67.7, DIG. 8, DIG. 9, DIG. 10, 67.9; D19/32, 34, 65; 40/659; 248/465.1, 450, 248/451
See application file for complete search history.

(56) References Cited

U.S. PATENT DOCUMENTS 432,038 A * 7/1890 Harding ..... 281/42
840,475 A * 1/1907 Conter ..... 281/42
898,669 A * 9/1908 Moore et al. ..... 281/42
1,150,678 A * 8/1915 Heazlewood ..... 281/42
1,587,335 A * 6/1926 Kline ..... 24/67.11
1,646,291 A * 10/1927 Horacek ..... 281/42
1,710,949 A * 4/1929 Pokora ..... 281/42
1,789,744 A * 1/1931 Heazlewood ..... 281/42
1,826,580 A * 10/1931 Spinney ..... 40/641
2,437,074 A * 3/1948 Chapin ..... 116/237
4,813,370 A 3/1989 Capamaggio ..... 116/237
4,928,621 A * 5/1990 Capamaggio ..... 116/234
4,932,351 A * 6/1990 Capamaggio ..... 116/237
5,191,682 A * 3/1993 Davis-Reardon et al. ..... 24/13
6,363,582 B1 * 4/2002 Van Bladel et al. ..... 24/67.3
D564,591 S * 3/2008 Lau ..... D19/65

* cited by examiner

*Primary Examiner*—Amy Cohen Johnson

(57) ABSTRACT

An improved bookmarker including a clip and a page retaining spring carried by the clip. A bottom of the clip defines a slot spaced apart from opposing side edges of the clip and an aperture spaced apart from the slot. The spring includes mounting leg having a retaining loop for insertion into the slot and a marking leg having a terminal loop.

6 Claims, 14 Drawing Sheets

BOOKMARKER

FIELD OF THE INVENTION

The invention disclosed herein pertains to an improved bookmarker for maintaining the place of a reader in a book.

DESCRIPTION OF THE PRIOR ART AND OBJECTIVES OF THE INVENTION

U.S. Pat. No. 4,813,370 to Capamaggio, the disclosure of which is incorporated in its entirety herein by reference, discloses a bookmarker for maintaining the place of a reader in a book. The bookmarker includes a unshaped clip for disposition on a book cover. A spring including a marking arm for keeping a page in the book is connected to the clip. While this bookmarker has proven effective, improvements to the marker are nonetheless desirable.

Therefore, an objective of the present invention is to provide a bookmarker having an improved clip for retaining a page retaining spring.

Another objective of the present invention is to provide a page retaining spring for the improved clip.

A further objective of the present invention is to provide an alternative embodiment of the page retaining spring for the improved clip.

Yet another objective of the present invention is to provide an alternative embodiment of the improved clip.

Still another objective of the present invention is to provide a page retaining spring with an improved terminal loop.

Various other objectives and advantages of the present invention will become apparent to those skilled in the art as a more detailed description is set forth below.

SUMMARY OF THE INVENTION

The aforesaid and other objectives are realized by providing a preferred embodiment of a bookmarker including a clip and a page retaining spring carried by the clip. A bottom of the clip defines a slot spaced apart from opposing side edges of the clip and an aperture spaced apart from the slot. The spring includes a mounting leg having a retaining loop for insertion into the slot and a marking leg having a terminal loop. The retaining loop includes a notch for snap fitting the loop through the slot. In an alternative embodiment of the page retaining spring, the retaining loop includes an additional, opposing notch.

In an alternative embodiment of the clip, the bottom defines an edge contiguous with one of the opposing side edges of the clip to provide a slot for receiving another alternative spring. The edge providing the slot includes a shoulder for retaining the alternative spring in the slot.

DETAILED DESCRIPTION OF THE PREFERRED EMBODIMENT AND OPERATION OF THE INVENTION

Figure 1:
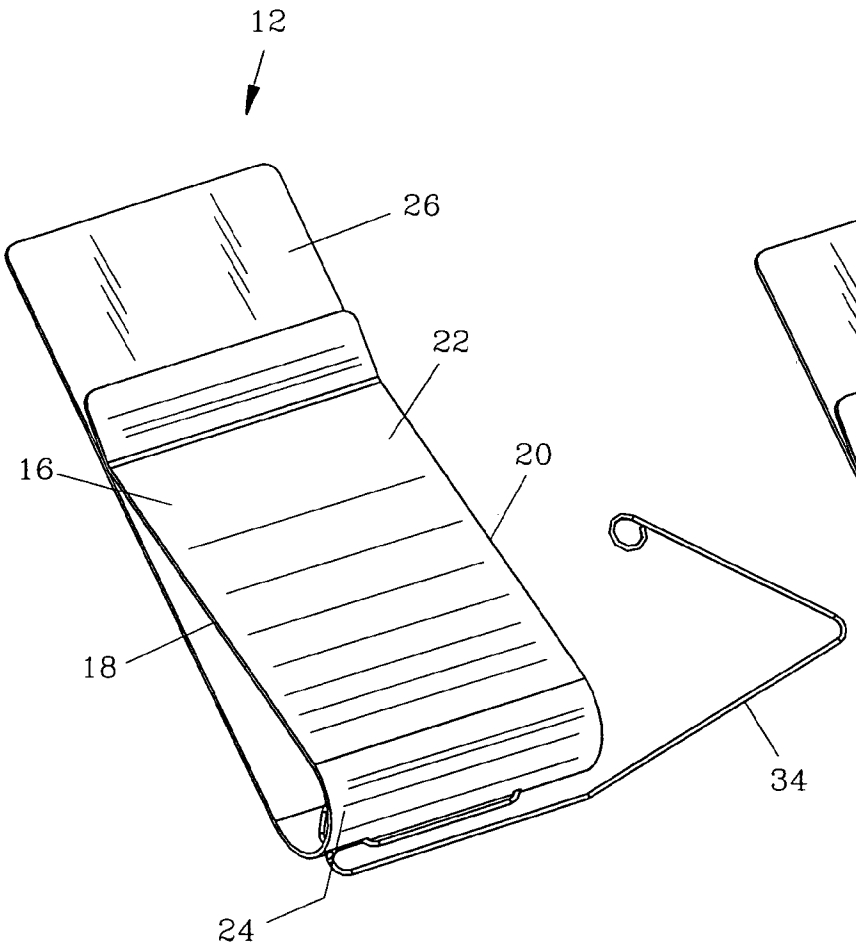
FIG. 1 is a front, top perspective view of a bookmarker according to a preferred embodiment of the invention having a clip and a page retaining spring.
Figure 2:
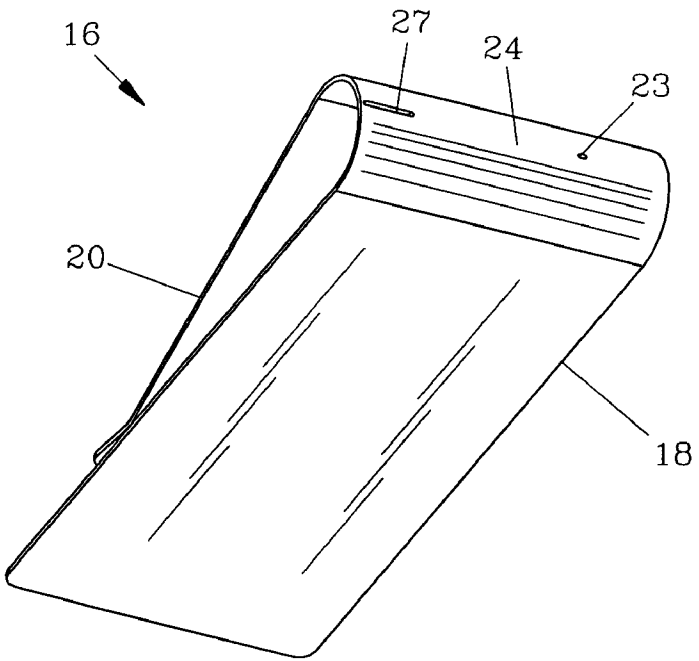
FIG. 2 is a bottom perspective view of the clip seen in FIG. 1.
Figure 4A:
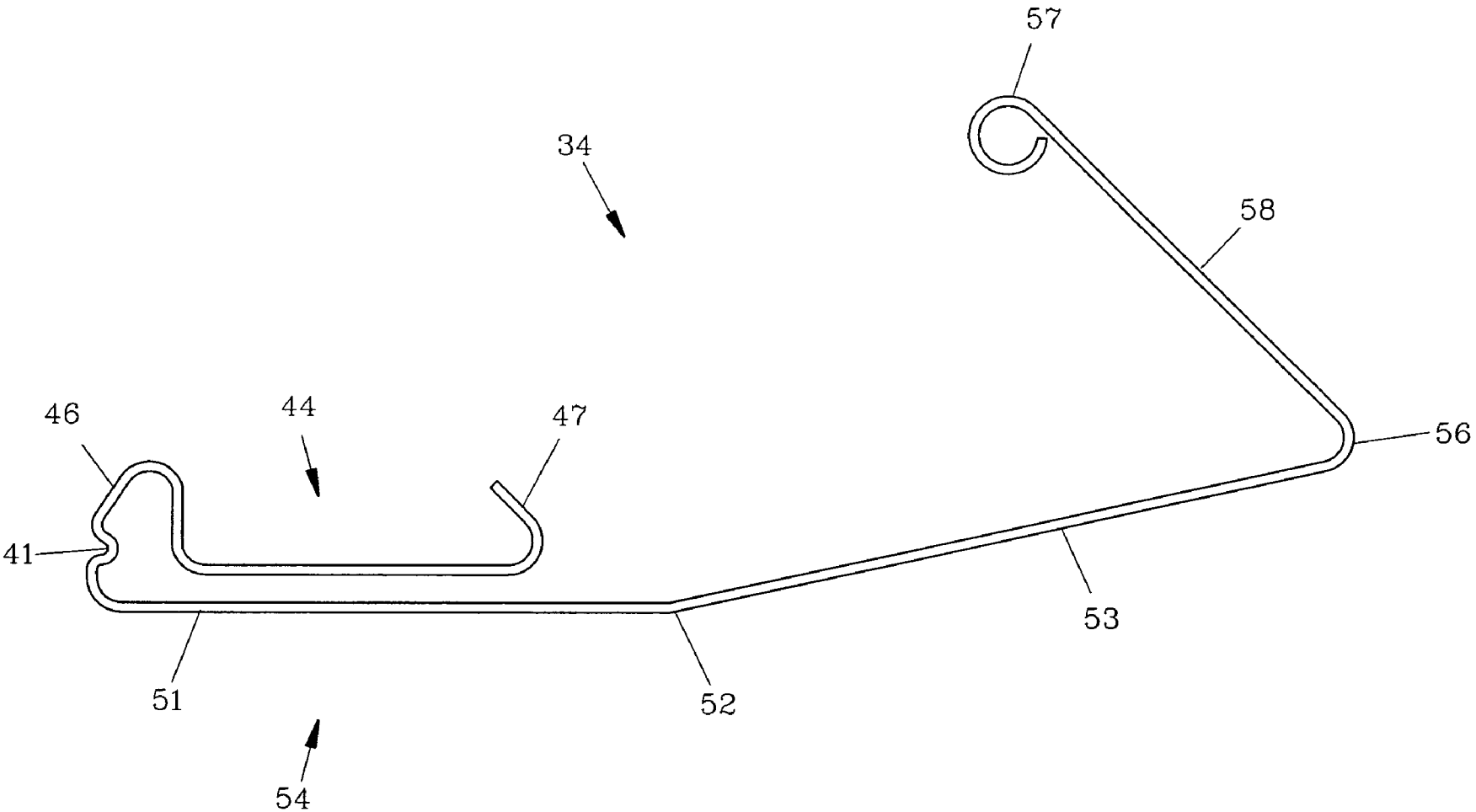
FIG. 4A is an enlarged front elevational view of the page retaining spring as seen in FIG. 3.
Figure 4F:
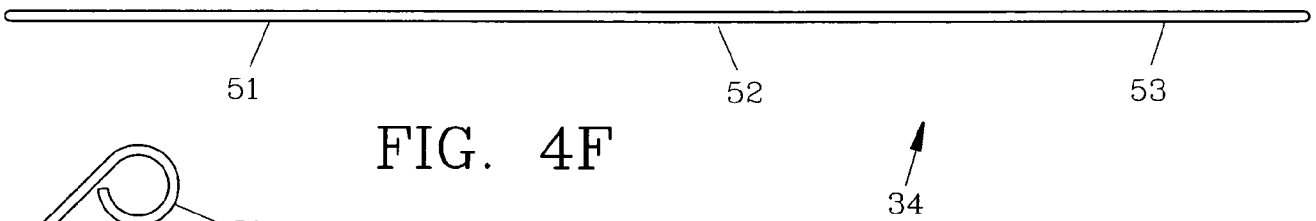
FIG. 4F is a bottom plan view of the page retaining spring as seen in FIG. 4A.
Figure 4B:
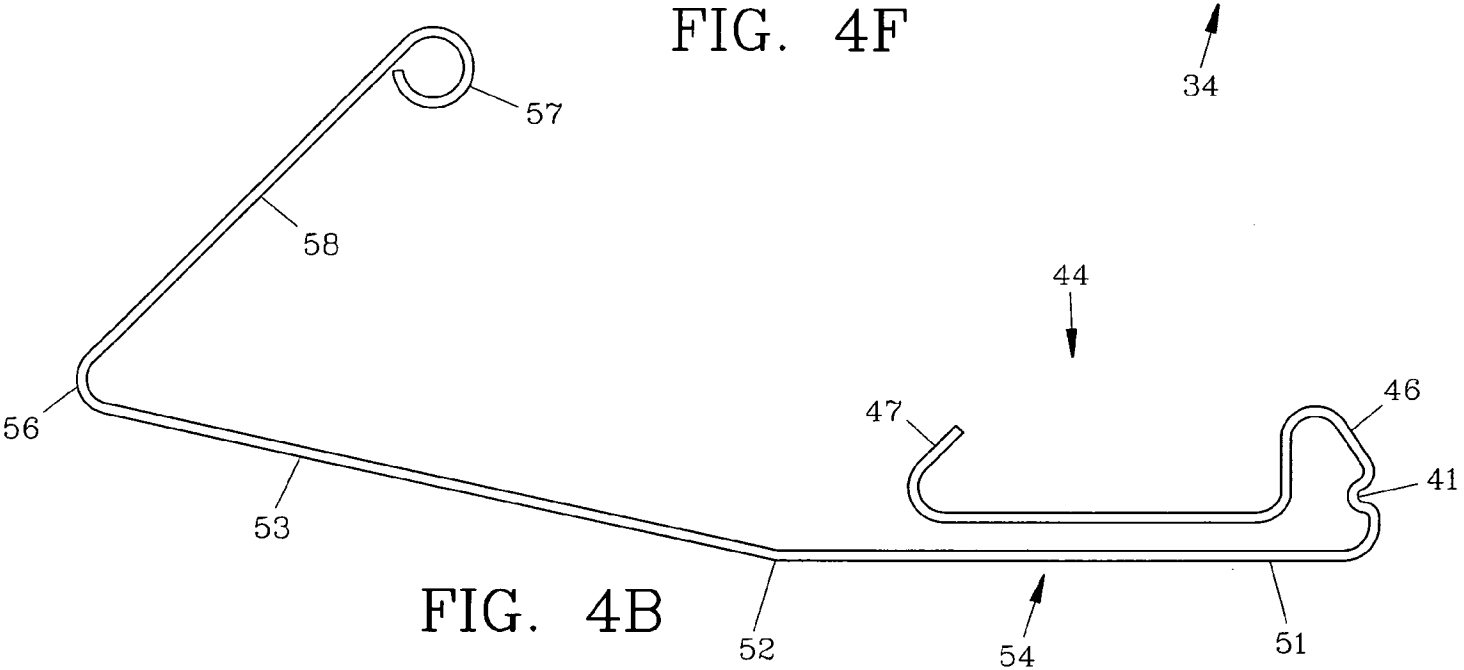
FIG. 4B is a rear elevational view of the page retaining spring as seen in FIG. 4A.
Figure 4E:
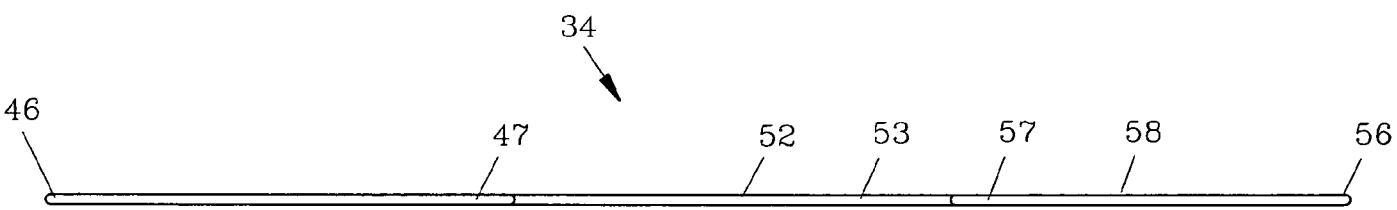
FIG. 4E is a top plan view of the page retaining spring as seen in FIG. 4A.
Figure 4C:
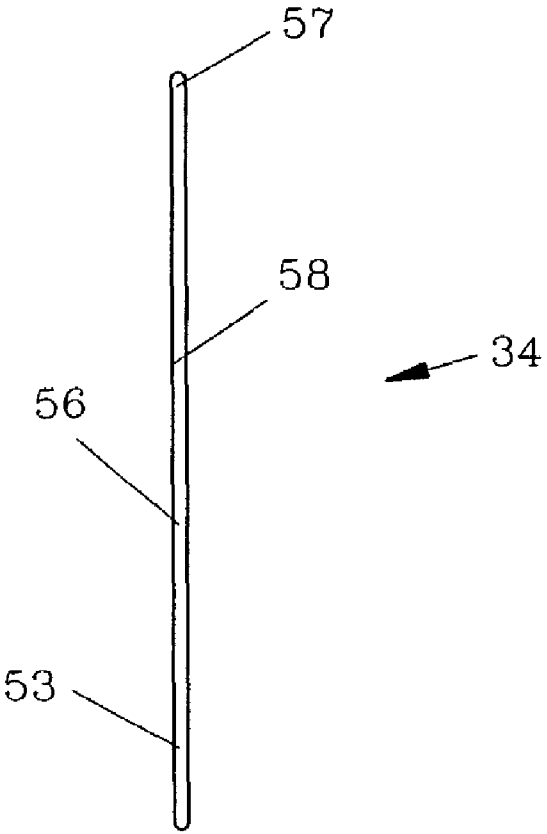
FIG. 4C is a right end elevational view of the page retaining spring as seen in FIG. 4A.
Figure 4D:
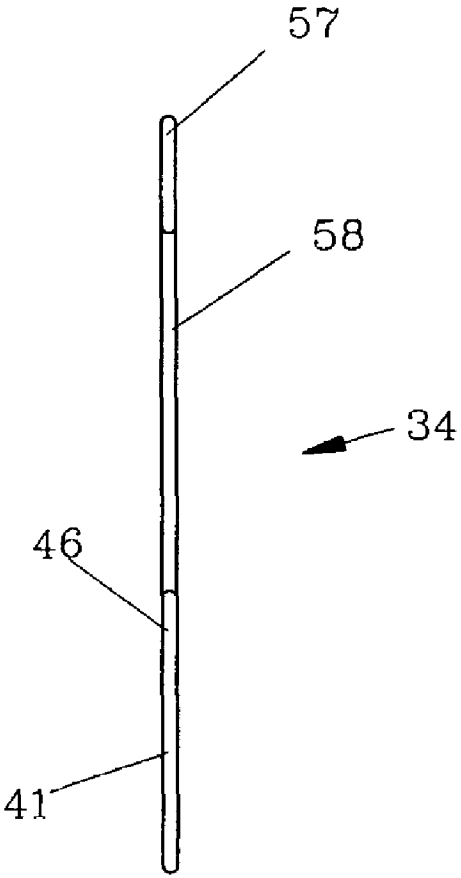
FIG. 4D is a left end elevational view of the page retaining spring as seen in FIG. 4A.
Figure 5A:
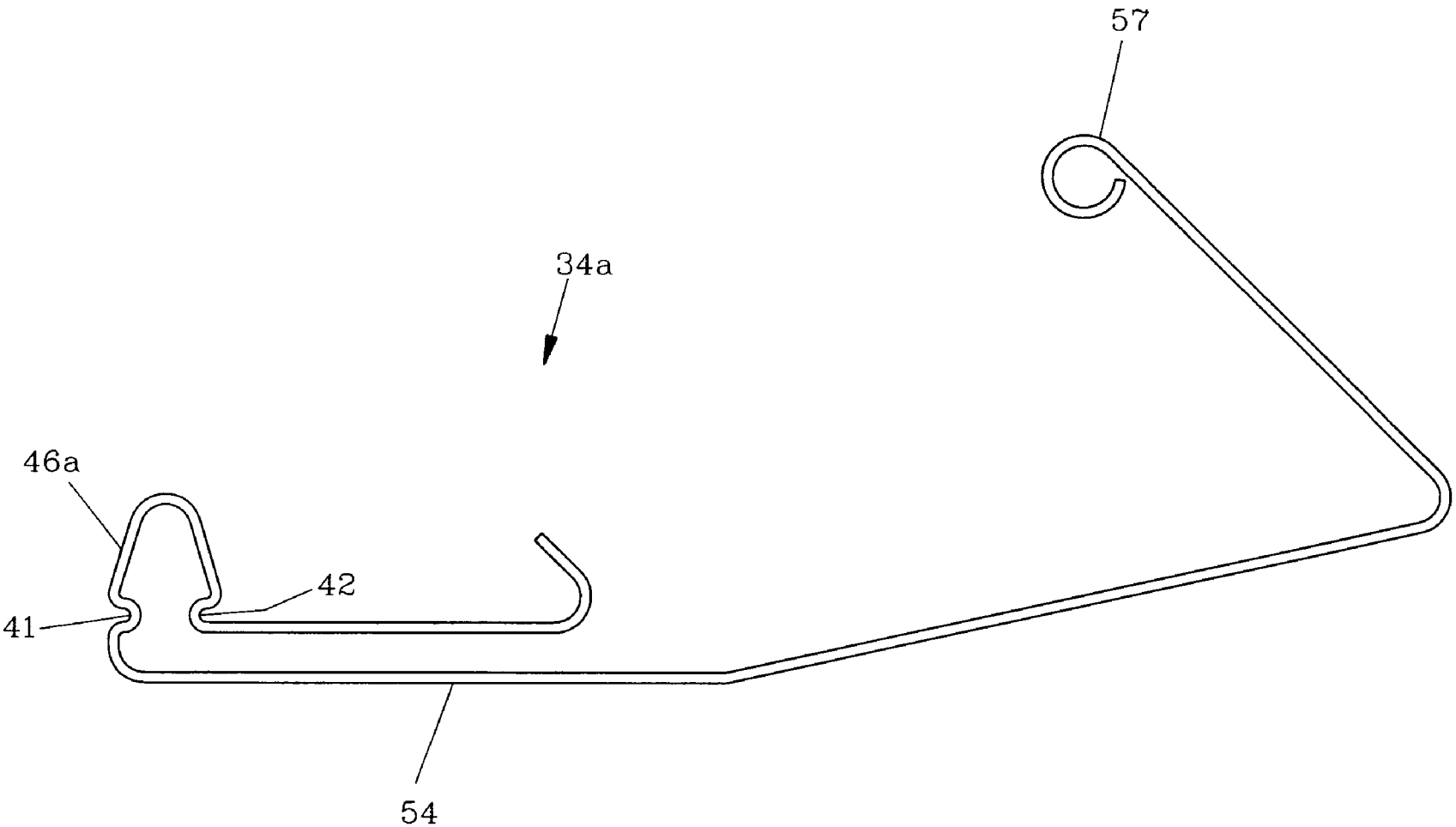
FIG. 5A is an enlarged front elevational view of an alternative embodiment of the page retaining spring.
Figures 5B, 5E, 5F:
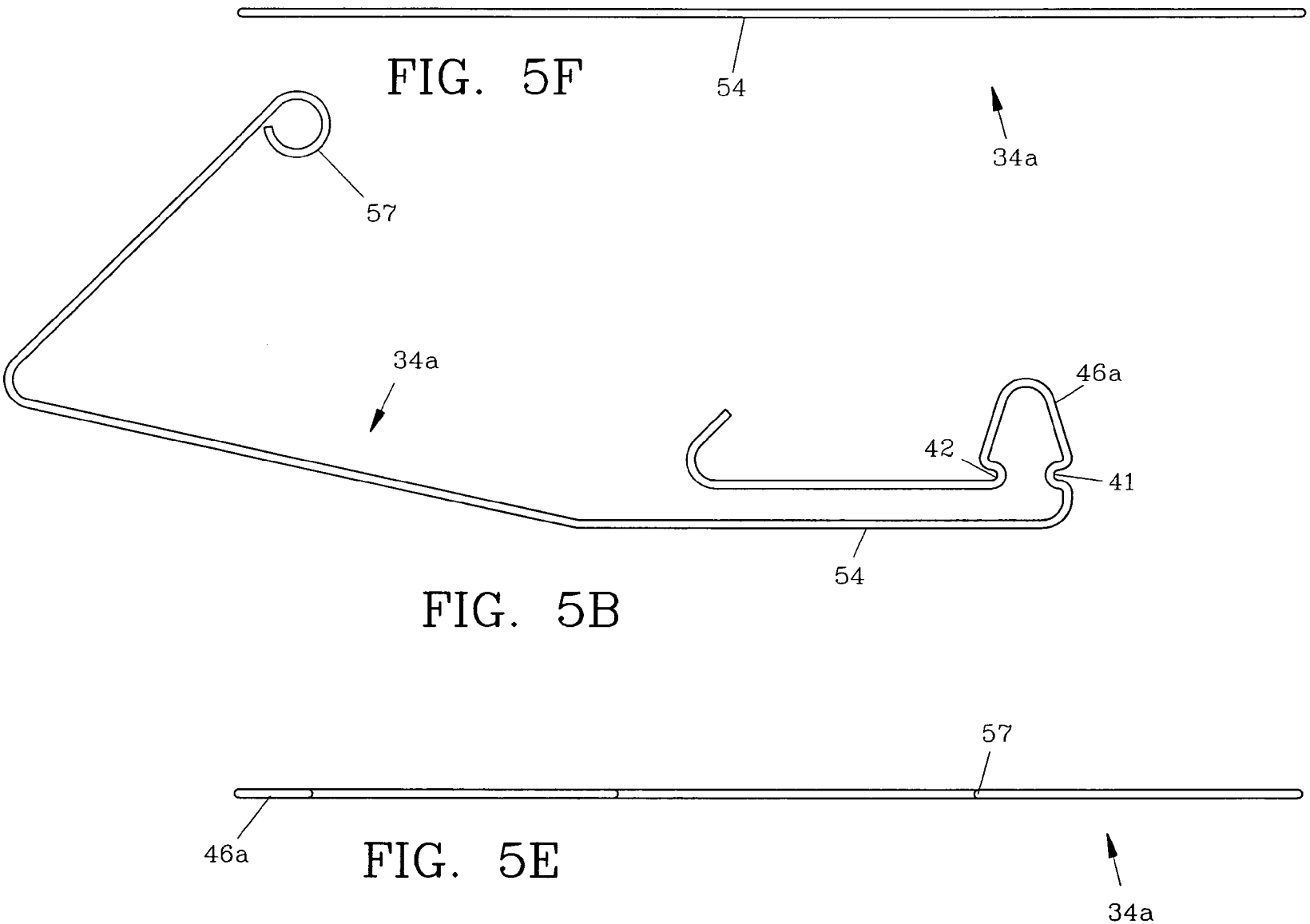
FIG. 5B is a rear elevational view of the page retaining spring as seen in FIG. 5A.
FIG. 5E is a top plan view of the page retaining spring as seen in FIG. 5A.
FIG. 5F is a bottom plan view of the page retaining spring as seen in FIG. 5A.
Figure 5C:
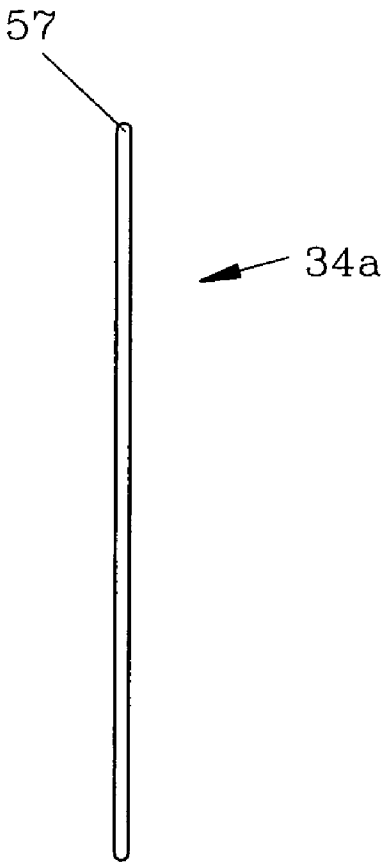
FIG. 5C is a right end elevational view of the page retaining spring as seen in FIG. 5A.
Figure 5D:
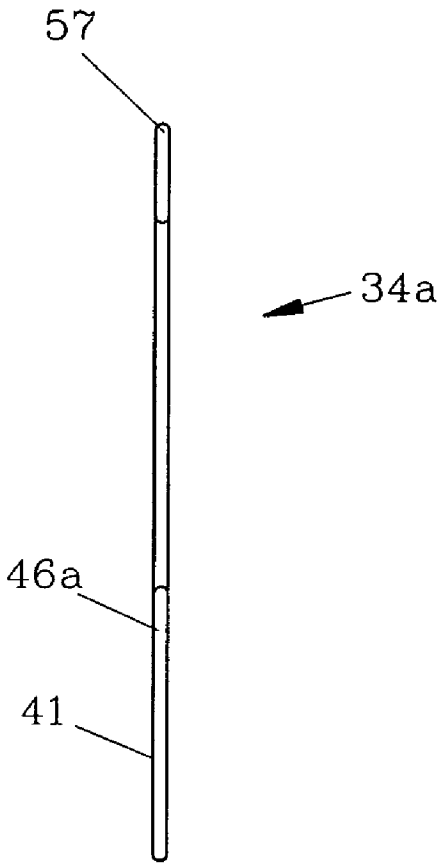
FIG. 5D is a left end elevational view of the page retaining spring as seen in FIG. 5A.

For a better understanding of the invention and its operation, turning now to the drawings, FIG. 1 shows a bookmarker 12 according to a preferred embodiment of the invention. The bookmarker 12 includes a page retaining spring 34 carried by a clip 16 having opposing side edges 18, 20 and a bottom 24 connecting an upwardly extending back 26 to an upwardly extending front 22. Clip 16 of bookmarker 12 shown in FIG. 1 can be mounted to the cover of a book with an end of page retaining spring 34 extending into the pages of the book as seen for example in FIG. 11. As seen in U.S. Pat. No. 4,813,370 to Capamaggio, FIGS. 2 and 2a show a similar marker 10 in relation to a book, although improvements to the marker 10 disclosed in U.S. Pat. No. 4,813,370 are the subject of this disclosure.

As seen in FIG. 2, the preferred embodiment of improved clip 16 includes bottom 24 defining a slot 27 spaced apart from opposing side edges 18, 20 and an aperture 23 spaced apart from slot 27.

FIGS. 3 and 4A-4F show the preferred embodiment of page retaining spring 34 for connection to clip 16. Retaining spring includes a leg 44 for mounting spring 34 to clip 16 and a leg contiguous with leg 44 for marking a book.

Figure 3:
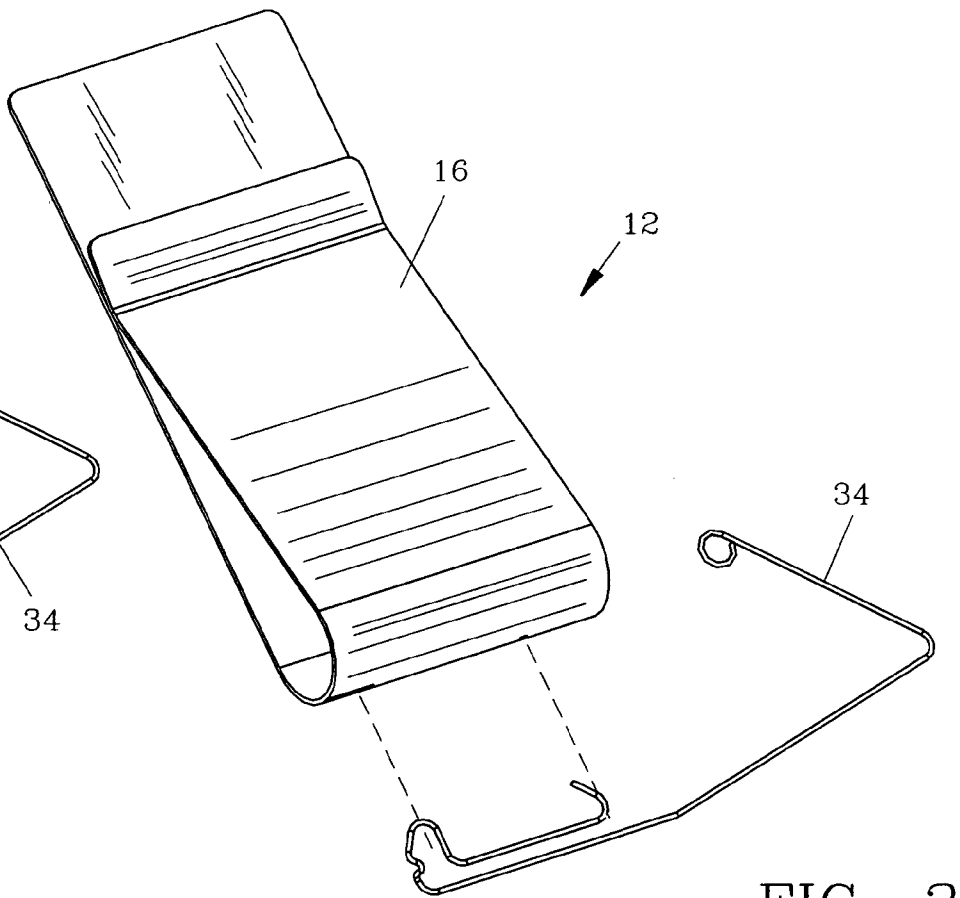
FIG. 3 is a front, top perspective view of the bookmarker showing a page retaining spring removed from the clip.

As seen in various views in FIGS. 4A-4F, the preferred embodiment of mounting leg 44 includes a terminal hook 47 for insertion into aperture 23 and a retaining loop 46 for insertion through slot 27 (FIGS. 2 and 3). Retaining loop 46 includes a notch 41 for snap fitting retaining loop 46 through slot 27.

Marking leg 54 includes a first span 51 extending from mounting leg 44 to an angular joint 52 with a second span 53. The second span 53 extends to another angular joint 56 with a marking member 58 that extends to terminal loop 57.

FIGS. 5A-5F show an alternative embodiment 34*a* of page retaining spring 34 shown in FIGS. 3 and 4A-4F. Page retaining spring 34*a* includes an additional notch 42 for securing retaining loop 46*a* in clip 16 shown in FIG. 2. Additional notch is disposed in opposing relation to notch 41. Marking leg 54 extends to terminal loop 57 as previously described for page retaining spring 34.

Figure 7:
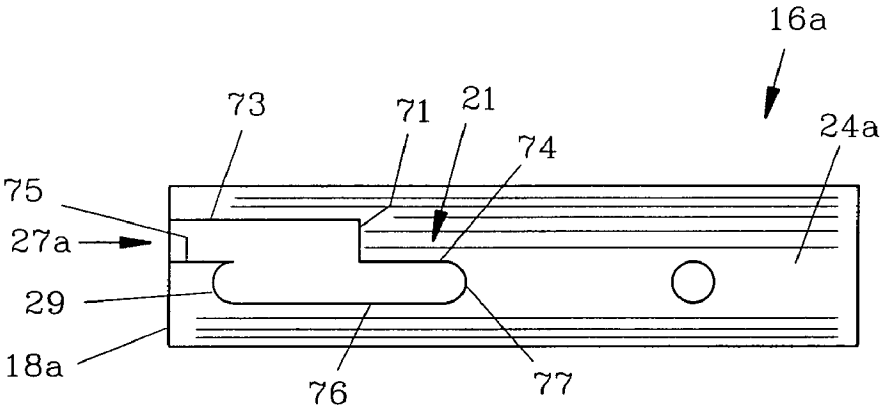
FIG. 7 is an enlarged bottom elevational view of the clip of the alternative embodiment as shown in FIG. 6.
Figure 6:
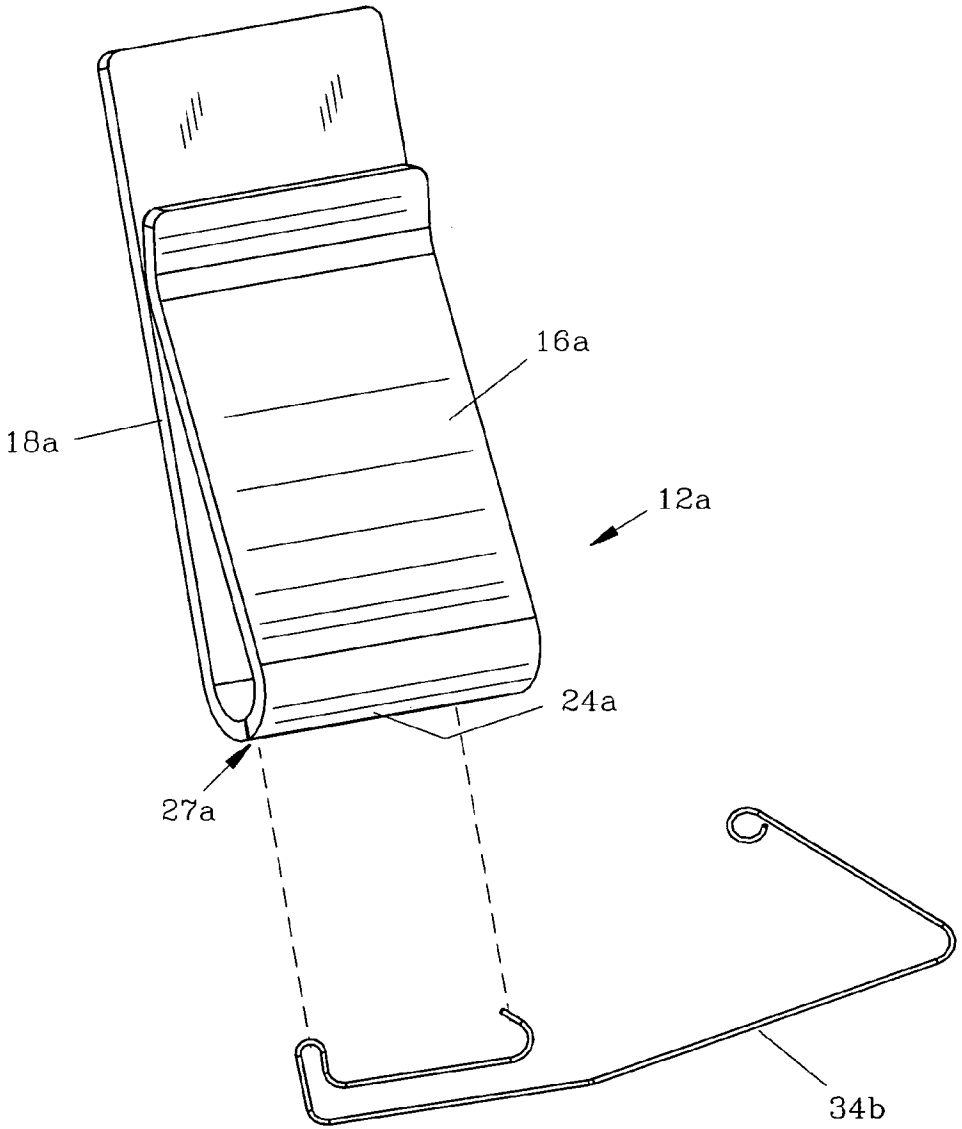
FIG. 6 is a front perspective view of an alternative embodiment of the bookmarker.

FIGS. 6 and 7 show an alternative embodiment 12*a* of the bookmarker 12 including alternate clip 16*a* and alternate page retaining spring 34*b* shown in more detail in FIGS. 10 and 10A-10F. Clip 16*a* as seen in FIG. 7 includes bottom 24*a* which defines a slot 27*a* having an edge 21 contiguous with side edge 18*a*. Edge 21 includes opposing parallel insertion portions 73, 75 contiguous with side edge 18*a*. A shoulder 29 receives alternate retaining loop 46*b* of retaining alternate spring 34*b* which is maintained between shoulder 29 and end portion 77 of edge 21 between opposing parallel retention portions 74, 76 seen in FIG. 7. A transverse portion 71 of edge 21 connects insertion portion 73 of edge 21 with retention portion 74.

Figure 8:
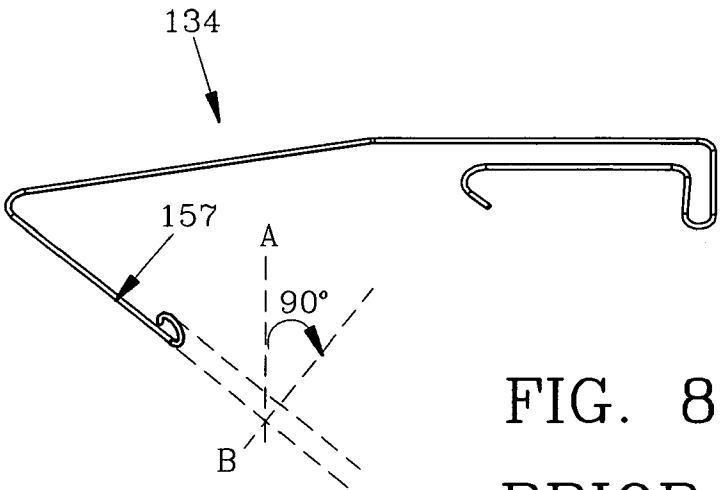
FIG. 8 PRIOR ART
FIG. 8 is an enlarged top perspective view of a prior art page retaining spring showing the disposition of a terminal loop.
Figure 9:
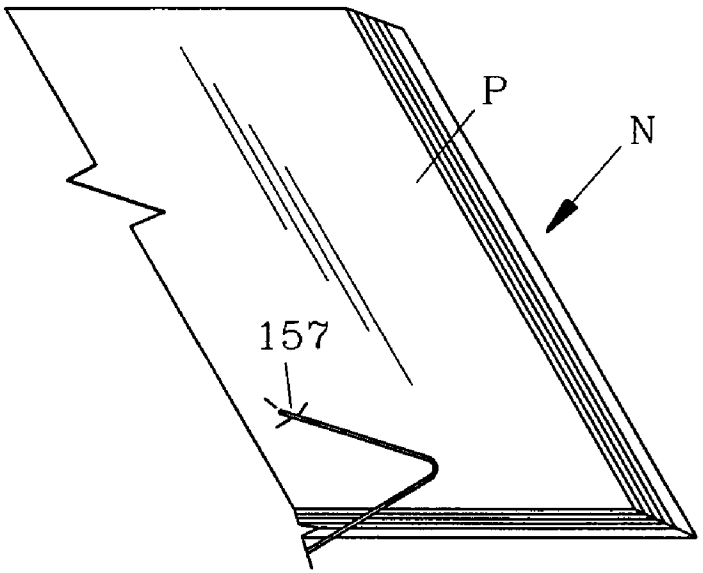
FIG. 9 PRIOR ART
FIG. 9 is a partial schematic bottom perspective view of the prior art terminal loop in use.
Figure 10E:
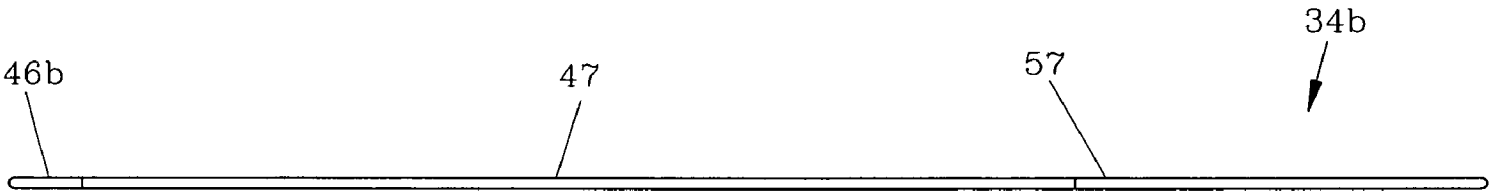
FIG. 10E is a top plan view of the page retaining spring as seen in FIG. 10A.
Figure 10A:
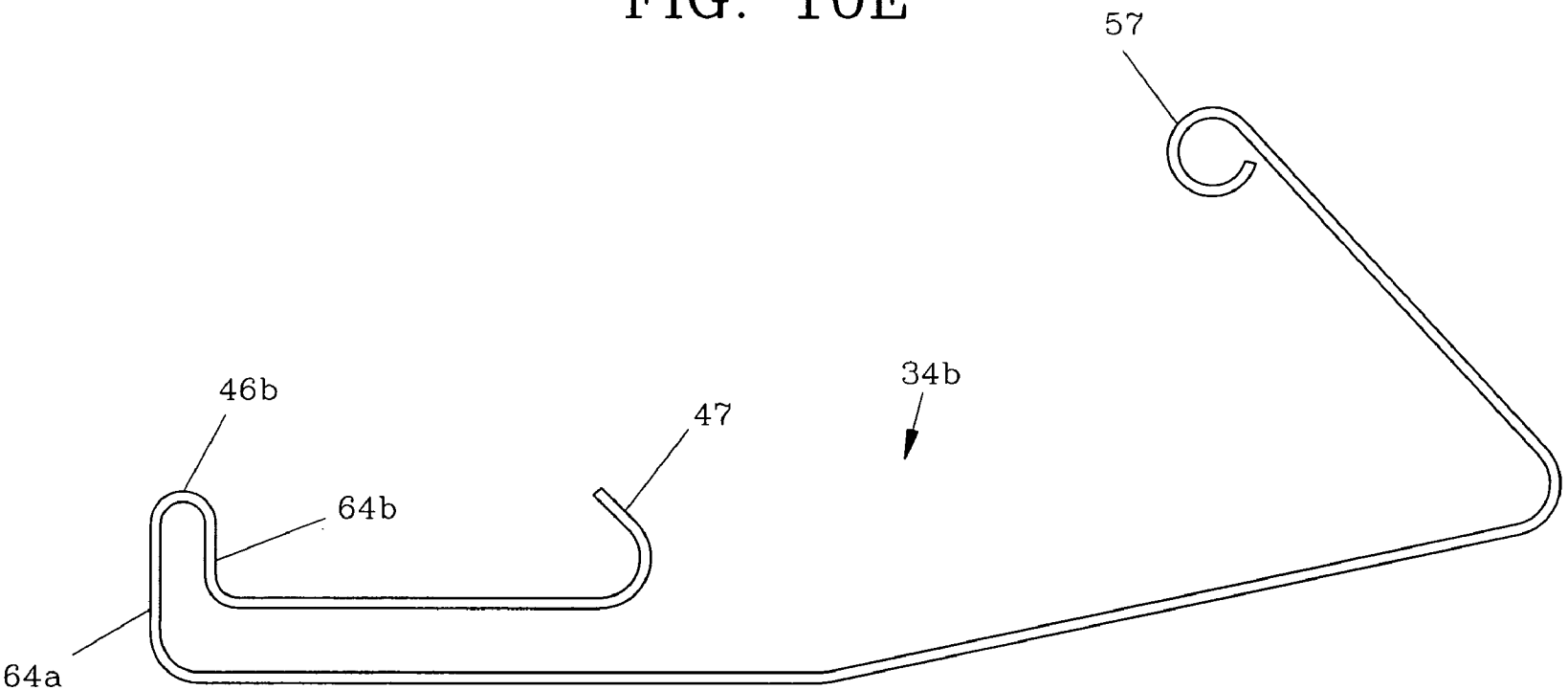
FIG. 10A is an enlarged front elevational view of the page retaining spring as seen in FIG. 10.
Figures 10B, 10F:
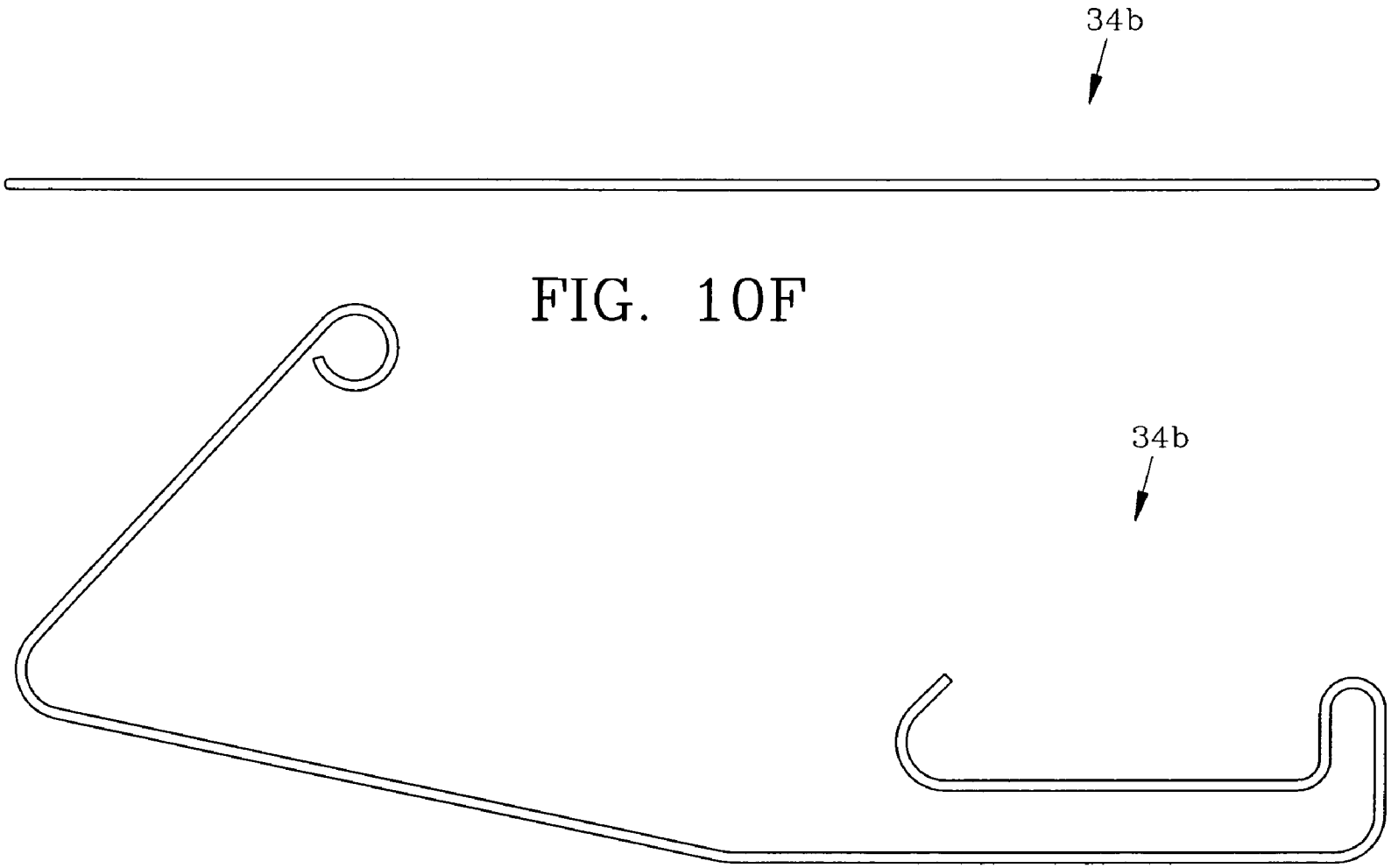
FIG. 10B is a back elevational view of the page retaining spring as seen in FIG. 10A.
FIG. 10F is a bottom plan view of the page retaining spring as seen in FIG. 10A.
Figure 10C:
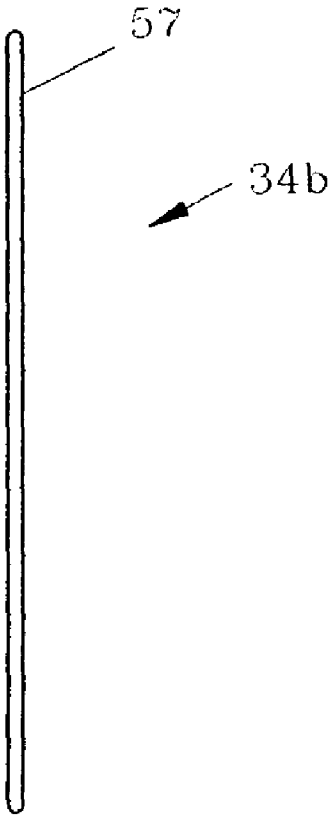
FIG. 10C is a right end elevational view of the page retaining spring as seen in FIG. 10A.
Figure 10D:
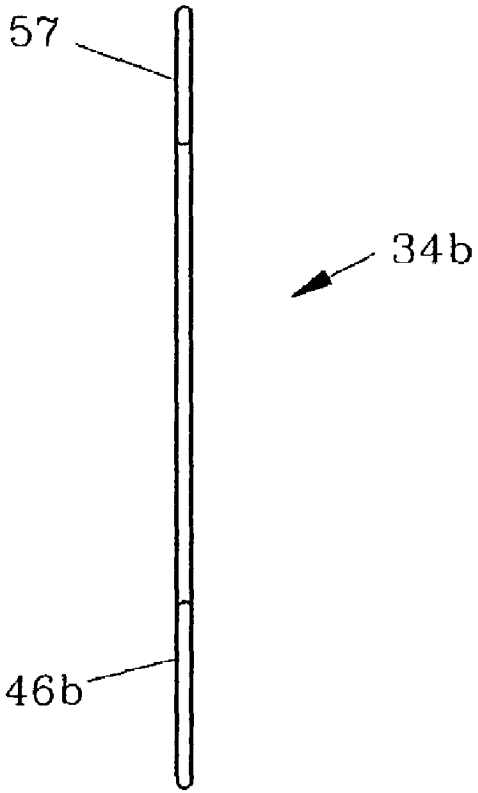
FIG. 10D is a left end elevational view of the page retaining spring as seen in FIG. 10A.

FIGS. 8 and 9 show a prior art page retaining spring 134 including a terminal loop 157. In FIG. 8, the reference axis A lies in substantially the same plane as retaining spring 134 and the reference axis B is generally perpendicular to that plane. Terminal loop 157 is disposed perpendicularly or approximately perpendicularly to axis B. Because terminal loop 157 extends outwardly from the pages P of a book N during use as seen in FIG. 9, the surface of the loop 157 bearing against pages P and the preceding pages of book N has a tendency to dent or mark pages P and the preceding pages of the book N with the prior art construction which is undesirable to the user (not shown).

Figure 10:
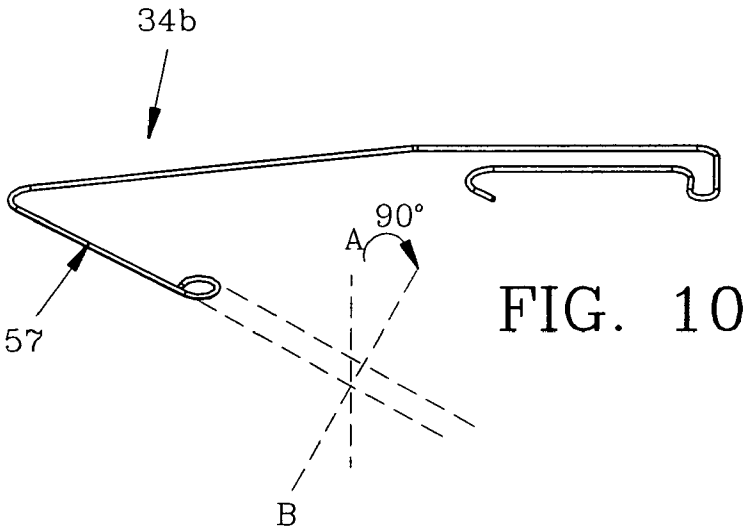
FIG. 10 is a top perspective view of a page retaining spring showing the disposition of the preferred terminal loop.
Figure 11:
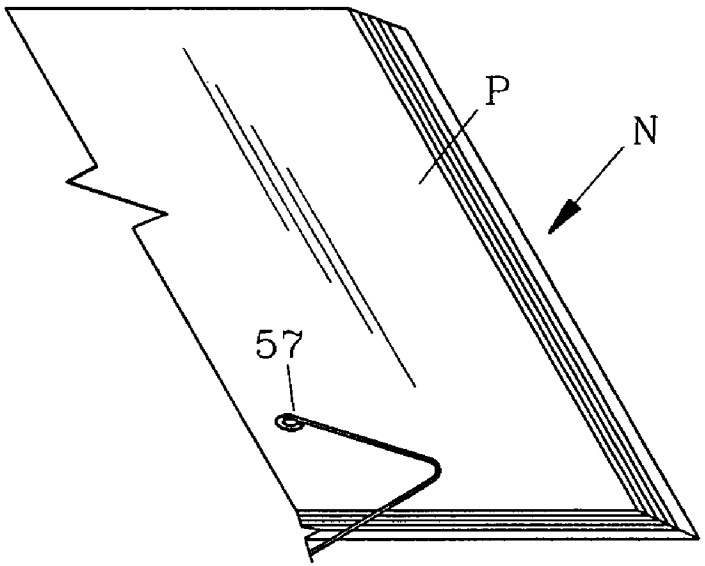
FIG. 11 is a bottom perspective view of the retaining spring showing the preferred terminal loop during use.

FIGS. 10, 10A-10F and 11 show various views of the alternate embodiment page retaining spring 34*b* having alternate retaining loop 46*b* and terminal loop 57 according to the preferred embodiment of the invention. Retaining loop 46*b* is shown having sides 64*a* and 64*b* received respectively within shoulder 29 and end portion 77 as seen in FIG. 7. In FIG. 10, the reference axis B and loop 57 lie in a plane that is generally perpendicular to the reference axis A. This construction of terminal loop 57 provides a greater surface area for bearing against pages P of book N when in use as seen in FIG. 11 and thus eliminates or at least reduces any damage to pages P when book N is closed (not shown). Also, while in the preferred embodiment of the invention, terminal loop 57 is disposed in a plane that is generally perpendicular to the axis A, disposition of loop 57 in a plane that forms an angle of only about thirty (30) degrees or more away from the reference axis A also reduces the tendency of loop 57 to damage pages P of book N.

The illustrations and examples provided herein are for explanatory purposes and are not provided to limit the scope of the appended claims.

We claim:

1. A bookmarker comprising:

a U-shaped clip, said U-shaped clip comprising:

opposing side edges; and a bottom, said bottom defining an elongated slot spaced apart from said side edges and an aperture spaced apart from said elongated slot; and a page retaining spring, said page retaining spring comprising a retaining loop, said retaining loop inserted in said elongated slot, said retaining loop defining a notch, said notch engaging an edge of said elongated slot, said page retaining spring further comprises a marking leg and a mounting leg, said mounting leg positioned linearly directly between said elongated slot and said aperture, a terminal hook, said terminal book attached to said mounting leg, said terminal hook positioned in said aperture.

2. The bookmarker according to claim 1 wherein said page retaining spring further comprises a terminal loop.

3. The bookmarker according to claim 2 wherein said terminal loop is disposed in a plane in substantially acute relation to a plane common to said marking leg and said mounting leg.

4. A bookmarker comprising:

a U-shaped clip, said U-shaped clip comprising:

opposing side edges; and a bottom, said bottom defining an edge contiguous with one of said opposing side edges to provide an elongated slot and an aperture spaced apart from said elongated slot, said edge providing said elongated slot defining opposing parallel retention portions and opposing parallel insertion portions and comprising a shoulder and an end portion; and a page retaining spring, said page retaining spring comprising a retaining loop for insertion in said elongated slot between said parallel insertion portions and maintained between said parallel retention portions, said retaining loop defining a pair of opposing notches, one of said pair of opposing notches engaging said shoulder and the other of said notches engaging said end portion.

5. The bookmarker according to claim 4 wherein said page retaining spring further comprises a hooked end for extension through said aperture, mounting leg, said mounting connected to said hooked and extending directly between said elongated slot and said aperture.

6. The bookmarker according to claim 4 wherein said edge of said elongated slot further comprises a transverse edge portion opposing said shoulder.

* * * * *